US006250505B1

(12) United States Patent
Petit

(10) Patent No.: US 6,250,505 B1
(45) Date of Patent: Jun. 26, 2001

(54) FLUID DISPENSERS

(75) Inventor: Robert G. Petit, Grafton, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/538,090

(22) Filed: Mar. 29, 2000

(51) Int. Cl.[7] ..... B65D 35/28

(52) U.S. Cl. ..... 222/95; 222/105; 222/135; 222/336; 222/387

(58) Field of Search ..... 222/95, 105, 135, 222/136, 386.5, 336, 340, 387, 145.1

(56) References Cited

U.S. PATENT DOCUMENTS

| | | | | |
|---|---|---|---|---|
| 3,241,722 | | 3/1966 | Nissan | 222/136 |
| 3,318,488 | | 5/1967 | Barnes | 222/182 |
| 3,335,913 | | 8/1967 | Bouet | 222/95 |
| 3,421,661 | | 1/1969 | Price | 222/94 |
| 3,454,198 | | 7/1969 | Flynn . | |
| 3,482,738 | * | 12/1969 | Bartels | 222/95 |
| 3,606,089 | * | 9/1971 | Chambers | 222/95 |
| 3,721,371 | | 3/1973 | Doiveck | 222/386.5 |
| 3,731,854 | | 5/1973 | Casey | 222/386.5 |
| 3,791,557 | | 2/1974 | Venus, Jr. | 222/105 |
| 3,838,796 | | 10/1974 | Cohen | 222/105 |
| 3,873,003 | | 3/1975 | Seiferth et al. | 222/95 |
| 3,876,115 | | 4/1975 | Venus, Jr. et al. | 22/183 |
| 3,940,026 | | 2/1976 | Kain | 222/212 |
| 3,951,310 | | 4/1976 | Steinman | 222/95 |
| 3,976,223 | * | 8/1976 | Jass et al. | 222/94 |
| 4,136,802 | * | 1/1979 | Mascia et al. | 222/95 |
| 4,222,499 | | 9/1980 | Lee et al. | 222/183 |
| 4,387,833 | | 6/1983 | Venus, Jr. | 222/95 |
| 4,423,829 | | 1/1984 | Katz | 222/95 |
| 4,492,313 | | 1/1985 | Touzani | 215/1 C |
| 4,964,540 | | 10/1990 | Katz | 222/95 |
| 5,370,250 | | 12/1994 | Gilbert | 215/100 |

FOREIGN PATENT DOCUMENTS

| | | |
|---|---|---|
| 38 32 938 | 3/1990 | (DE) . |
| 42 13 350 | 10/1993 | (DE) . |
| WO 88/07963 | 10/1988 | (WO) . |

OTHER PUBLICATIONS

M. Joseph–Eugene–Baptiste "DE Voyage ET DE Campement, ECT" Dec. 16, 1921.

* cited by examiner

*Primary Examiner*—Kevin Shaver
*Assistant Examiner*—F. Nicolas
(74) *Attorney, Agent, or Firm*—Fish & Richardson P.C.

(57) ABSTRACT

A fluid dispenser is provided including (a) a flexible receptacle, having a closed end and an opposed open end, being movable from a collapsed condition to an elongate condition, and having an outer surface defining a helical thread, and (b) a helical spring in threaded engagement with the helical thread to axially compress the receptacle. Fluid introduced into said receptacle moves the receptacle from its collapsed condition to its elongate condition, producing tension in the spring, the tension being effective to move the receptacle from its elongate condition to its collapsed condition to force fluid from the receptacle.

17 Claims, 7 Drawing Sheets

FLUID DISPENSERS

BACKGROUND OF THE INVENTION

The present invention relates to fluid dispensers.

In the field of fluid dispensing, particularly the dispensing of toiletries such as shaving gels, lotions, etc., much of the present-day packaging employs either pressure, provided by fluorocarbons or other propellants, or hand-operated pumps.

Pressurized containers often provide excellent dispensing performance. However, these containers are generally pressurized in excess of 30 psi and at times may provide a seal leak, in which instance the package becomes incapable of expelling its contents. Pressure leaks can occur in many areas, the bottom grommet and container seams being the most vulnerable. Further, the use of propellants in pressurized containers has recently led to criticism due to possible effects on the environment.

Pump systems generally dispense a metered amount, and, because consumers may have different requirements, difficulty arises in providing a proper metered amount that is satisfactory to all users. Thus, the consumer may need to pump the dispenser several times to dispense a desired amount of fluid, which is viewed as an inconvenience by some consumers. Additionally, pump systems may tend to jam or clog over a period of time.

Various other arrangements have been proposed, in which a collapsible container contains material that is forced from an expanded condition to a nonexpanded condition by a spring mechanism that pushes axially on the base of containers to collapse it towards the dispensing end of the container.

SUMMARY OF THE INVENTION

The invention provides fluid dispensers that operate without pressurization or a pump mechanism. Advantageously, the fluid dispensers are simple to manufacture, and are relatively trouble-free during use.

In one aspect, the invention features a fluid dispenser including (a) a flexible receptacle, having a closed end and an opposed open end, being movable from a collapsed condition to an elongate condition, and having an outer surface defining a helical thread, and (b) a helical spring in threaded engagement with the helical thread to axially compress the receptacle. Fluid introduced into the receptacle moves the receptacle from the collapsed condition to the elongate condition, producing tension in the spring, the tension being effective to move the receptacle from the elongate condition to the collapsed condition to force fluid from the receptacle.

Preferred embodiments may include one or more of the following features. The dispenser further includes a container having a closed end and an opposed open end, the open end of the receptacle being attached to the container adjacent the open end of the container and the receptacle being freely supported within the container. The dispenser further includes a valve constructed to prevent fluid from being forced out of the receptacle until the dispenser is actuated by a user. The receptacle includes an outwardly projecting crest portion and an inwardly projecting root portion. The helical spring is disposed on the root portion. The helical spring is encased within the root portion. The receptacle is formed of a plastic material. The helical spring is formed of a metallic material.

In another aspect, the invention features a fluid dispenser including (a) a first flexible receptacle having a closed end wall and an opposed open end, and an outer surface defining a helical thread that is movable from a collapsed condition to an elongate condition, (b) a second flexible receptacle, disposed within the first receptacle, having a closed end wall attached to the closed end wall of the first receptacle and an open end adjacent the open end of the first receptacle, and (c) a helical spring threadedly received on the outer surface of the first receptacle. Fluid material forced into the first receptacle is effective to move the first receptacle from a collapsed condition to an elongate condition producing tension in the spring, and the tension in the spring is effective to move the first receptacle from an elongate condition to a collapsed condition to force material from the first and second receptacles.

Preferred embodiments may include one or more of the following features. The dispenser further includes a valve constructed to prevent fluid from being forced out of the receptacle until the dispenser is actuated by a user. The helical thread includes an outwardly projecting crest portion and an inwardly projecting root portion. The helical spring is disposed on the root portion. The valve includes a valve assembly constructed to translate between a closed position, in which the first and second receptacles are sealed, and an open position, in which first and second components flow simultaneously from the first and second receptacles to a dispensing head. The dispensing head defines a nozzle through which the product exits the dispensing head, a first passageway between the first receptacle and the nozzle, and a second passageway between the second receptacle and the nozzle. The valve assembly includes first and second valve seats, and a valve stem including a first valve portion for sealing against the first valve seat to seal the first receptacle and a second valve portion for sealing against the second valve seat to seal the second receptacle. The valve assembly further includes a spring that biases the first and second valve portions against the respective first and second valve seats. The valve assembly further includes a valve body, and the spring, valve stem and valve seats are contained within the valve body as a modular unit.

Other features and advantages will be apparent from the following description of a presently preferred embodiment, and from the claims.

DESCRIPTION OF THE PREFERRED EMBODIMENTS

Figure 1:
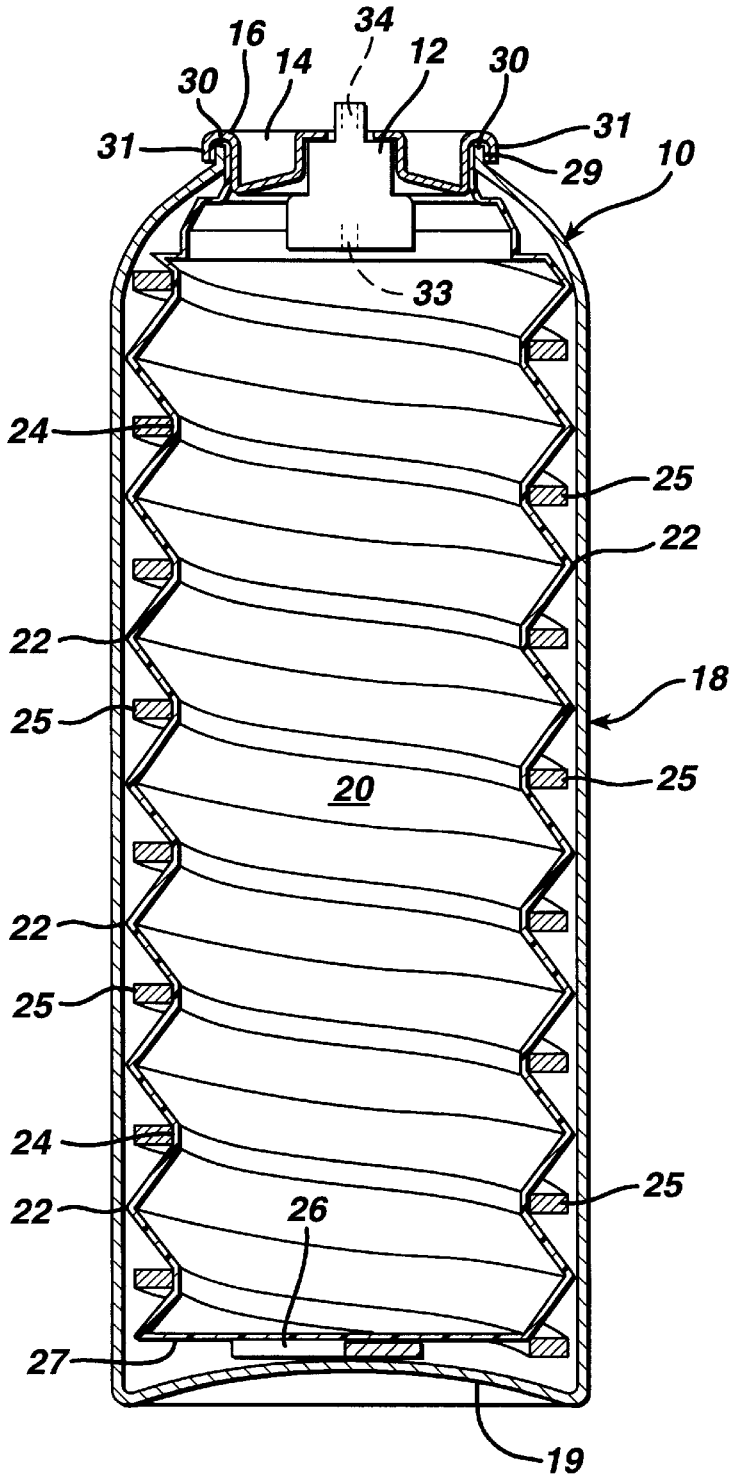
FIG. 1 is an elevational sectional view showing a fluid dispenser according to one embodiment of the invention.
Figure 2:
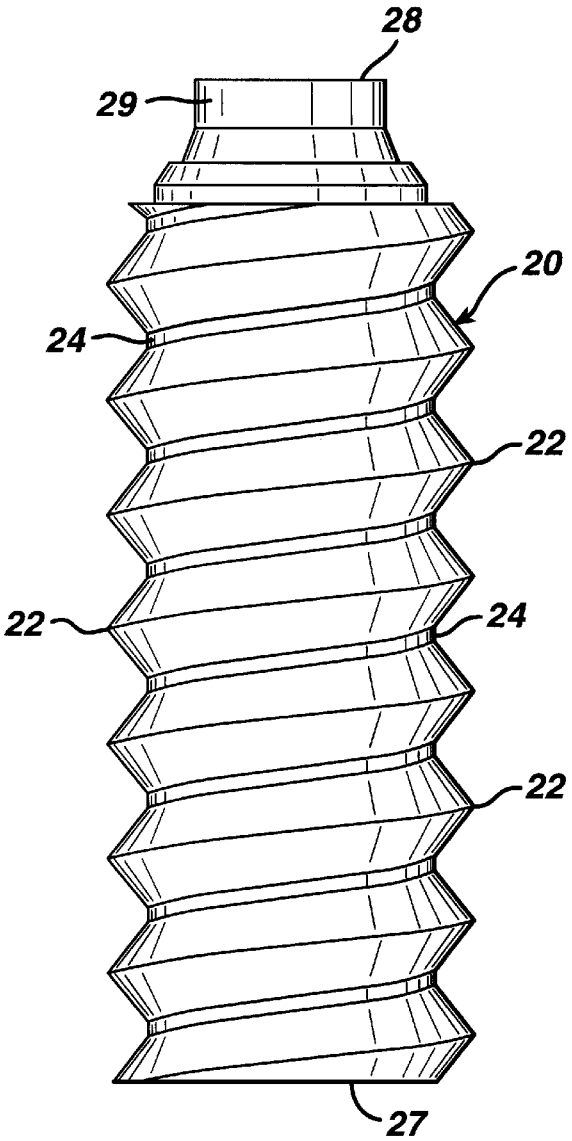
FIG. 2 is an elevational view showing the receptacle of the dispenser of FIG. 1.
Figure 3:
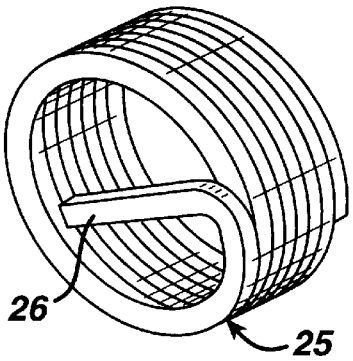
FIG. 3 is a bottom perspective view showing the spring of the dispenser of FIG. 1.

Referring to FIGS. 1–4, a fluid dispenser 10 includes a valve 12 that is sealingly attached to a valve cup 14, which in turn is sealingly fixed at the open end 16 of a container 18, the container having a closed end opposite the valve 12 to form an enclosed container. A flexible elongated receptacle 20, typically formed of a plastic, e.g., PET or nylon, is provided within the enclosed container for holding a fluid to be dispensed. Suitable receptacles are flexible enough to be easily compressed during dispensing, yet strong enough to withstand the applied pressure.

Figure 4:
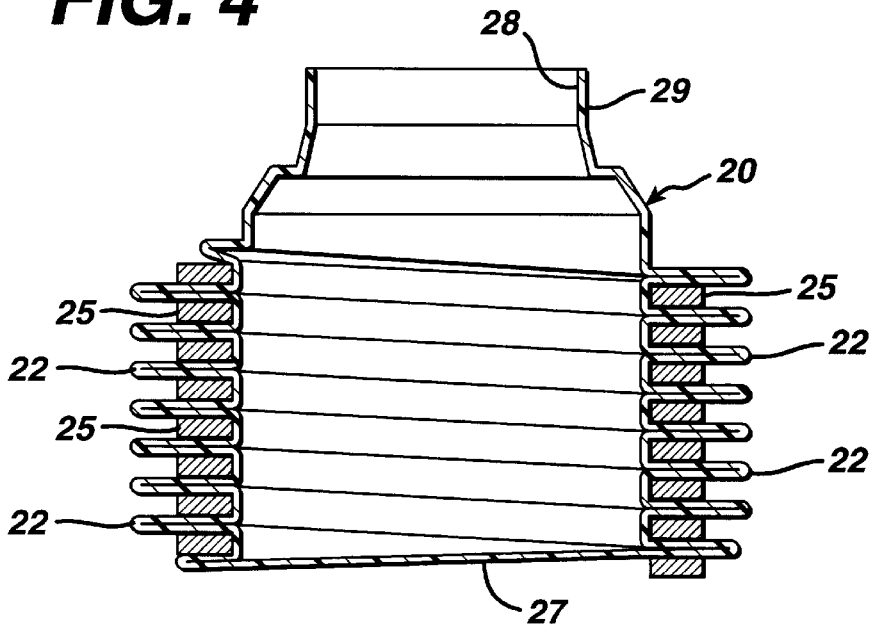
FIG. 4 is an elevational sectional view showing the receptacle and spring of FIGS. 2 and 3 in an assembled condition.

Receptacle 20 has an open end 28 that is surrounded by a skirt 29 that is sealed between a lip 30 on the container 18 and flange 31 of the valve cup 14. The receptacle 20 has an outer surface in the form of a helical thread, the helical thread having an outwardly projecting crest portion 22 and an inwardly projecting root portion 24. A helical spring 25, which is constructed of steel or other metallic material, is assembled onto the receptacle 20 by threading the coils of the spring 25 onto the root portion 24 of the receptacle 20. The elongated receptacle 20 is thus compressed axially, as shown in FIG. 4, and both axially and radially retained within the coils of the spring 25. The spring 25 has a tang 26 disposed at the lower end thereof (FIG. 1), which is effective to support the lower closed end 27 of the receptacle 20.

The valve 12 includes a valve stem (not shown) that is movable to provide an open or closed position of the valve, an inlet 33, and an outlet 34. Any type of check valve that controls fluid flow between the receptacle and the atmosphere may be used.

To prepare the dispenser 10 for use, the receptacle 20 is installed into the container 18 in the condition shown in FIG. 4. That is, the spring 25 is threaded onto the surface of the receptacle 20, after which the receptacle is assembled onto the container 18 in sealing relation with the valve cup 14, the valve 12 also being assembled onto the valve cup. The normally closed valve is then opened by a filling head (not shown) and fluid material to be dispensed is then forced under pressure, through the open valve, into the receptacle 20 which assumes the elongated state shown in FIG. 1. When the receptacle 20 is elongated, the coils of the spring 25 are under tension. The valve 12 is then closed to maintain the pressure within the receptacle 20. It will be noted that, with the spring 25 disposed as shown in FIG. 4, the filling of the receptacle 20 with the fluid material will cause the receptacle 20 to elongate substantially equally over its length due to the spring constant of the spring 25. In addition, the spring 25 prevents outward bulging of the receptacle during the filling process, ensuring a linear movement of the receptacle from the position shown in FIG. 4 to that shown in FIG. 1.

To dispense fluid from the dispenser 10, the user presses an actuator (not shown), which opens valve 12, allowing fluid to flow from the dispenser. As a result, the spring 25 moves towards its initial compressed state, forcing the fluid out of the receptacle until the user releases the actuator and the valve 12 closes. In addition to dispensing fluid, the spring 25 also maintains linear movement of the receptacle 20, from the position shown in FIG. 1 to that of the position shown in FIG. 4, by providing substantially equal movement of the coils in the upward direction. The contact between the spring 25 and the root 24 of the helical outer surface of the receptacle 20 maintains the bellows shape of the receptacle 20 during dispensing.

The characteristics of the spring 25 and valve 12 will depend on the fluid to be dispensed. Viscous fluids will generally require a higher spring pressure and/or a larger valve opening than relatively low viscosity fluids. For a given viscosity fluid, the spring force required to dispense at a desired flow rate will be determined by the valve opening size (a larger valve opening will require less spring force) and the force required to compress the receptacle (the lower the compression force, the lower the required spring force). If the valve opening size and compression force are held constant, the higher the viscosity of the fluid the higher the required spring force will be. Suitable springs may be selected empirically based on these factors.

Figure 5:
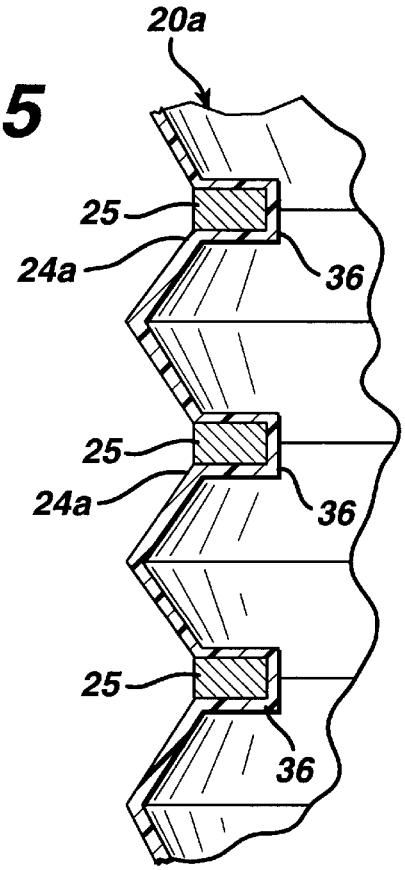
FIG. 5 is a fragmentary sectional view showing receptacle/spring assembly according to an alternate embodiment of the invention.

It may be desirable to manufacture the receptacle and the spring as a compound unit, to facilitate final assembly of the dispenser. FIG. 5 shows such an alternate embodiment of the invention, in which the root 24*a* of the helical outer surface of receptacle 20*a* has an inwardly projecting portion 36 that is formed about the spring 25. The assembly of the spring 25 and receptacle 20*a* forms a unit that can be easily assembled into the container 18.

Figure 6:
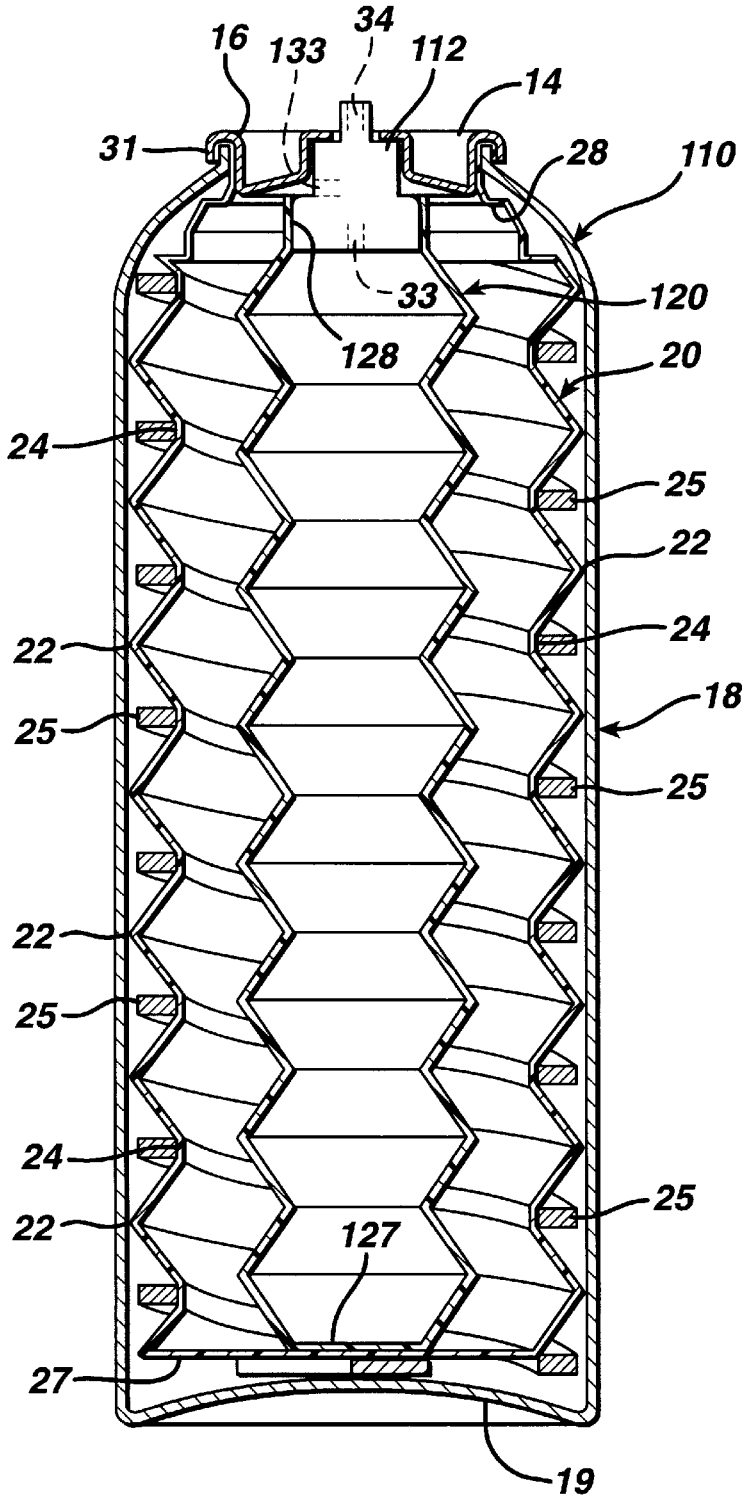
FIG. 6 is an elevational sectional view showing a dispenser according to another alternate embodiment of the invention.

FIG. 6 shows a dispenser 110 that is suitable for dispensing a composition that includes two components that should be stored separately. In dispenser 110, a second receptacle 120 is disposed within receptacle 20, so that a second component can be stored separately from the component in the receptacle 20. The two components of the composition are either mixed while being dispensed, or dispensed to a mixing head and then dispensed from the mixing head as a mixture. The inner receptacle 120 has a closed end 127 that is attached to the closed end 27 of the receptacle 20 in sealing engagement. The upper, open end 128 of inner receptacle 120 is sealingly engaged to the lower surface of a valve 112, the valve 112 being attached to the valve cup 14 in similar manner to that of the valve 12, described in detail at FIGS. 1–4. The inner receptacle 120 may be manufactured of the same material as the outer receptacle 20 and may take a similar form having a helical-shaped outer surface, or have a non-helical bellows-shape.

Still referring to FIG. 6, the valve 112 has an outlet opening 34 to the atmosphere and an inlet opening 33 allowing fluid to flow from the inner receptacle 120 when the valve 112 is open. Additionally, an opening 133 is provided from the outer receptacle 20 into the valve 112 to allow fluid to flow from the receptacle 20 into the valve. The components may be mixed within the valve 112 in any manner well-known in the art, may flow in separate streams through the opening 34 to be mixed in the atmosphere upon release, or may be dispersed to a secondary mixer (not shown) mounted above the valve cup 14.

Valves that are suitable for use in this embodiment of the invention are described, e.g., in the assignee's co-pending application U.S. Ser. No. 09/574,312, titled "Systems for Dispensing Multi-component Products", the disclosure of which is incorporated herein by reference. A valve of this type is shown in FIG. 10 and described briefly below.

Figure 10:
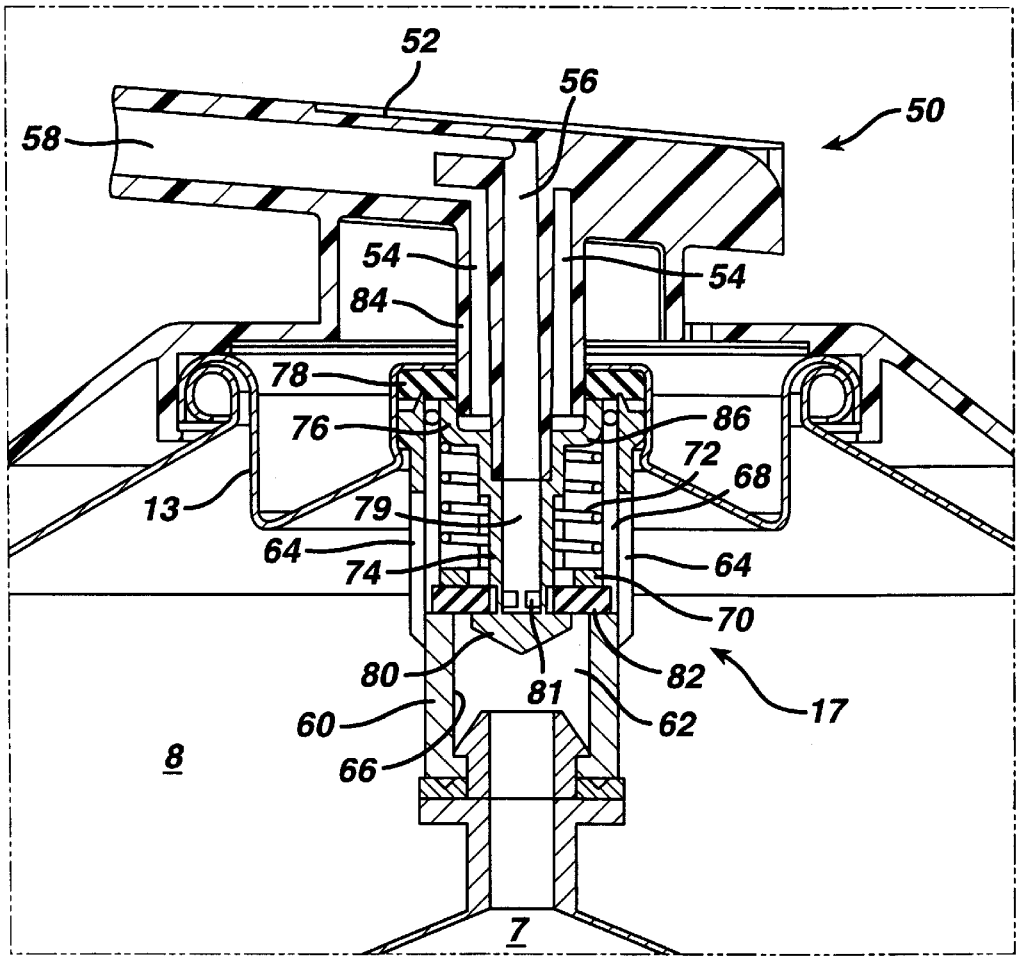
FIG. 10 is a cross-sectional view of a valve assembly used in the fluid dispenser.

As shown in FIG. 10, valve subassembly 17 includes a valve body 60, which is constructed to be mounted on valve cup 13 and crimped in place. Valve body 60 defines a central passage 62, and a plurality of side openings 64. Inner wall 66 of valve body 60 includes a plurality of ribs 68 and a shoulder 70, to support a spring 72. Valve stem 74 is mounted within a spring 72, which biases first valve portion 76 against first valve seat 78 and second valve portion 80 against second valve seat 82, so that both valve portions are biased towards a closed position. Preferably valve seats 78 and 82 are resilient gaskets, to provide a fluid-tight seal when the valve is in a closed position. Valve stem 74 also includes a central bore 79, in communication with passage 56 of the dispensing head, and a plurality of openings 81 which are unavailable for fluid flow from chamber 7 when the valve is closed, but which allow the second component to flow from chamber 7 into passage 56 when the valve opens.

Dispensing head 50 includes an actuating stem 84, which extends into and seats in a cup-shaped area 86 of the valve stem 74. When actuator 52 is depressed, actuating stem 84 presses valve stem 74 down, against the biasing force of spring 72. This movement simultaneously moves both valve portions away from the corresponding valve seats, moving the dispensing system to its open position, shown in FIG. 2A. Importantly, the two valves are opened simultaneously, and no material is released from either chamber into the passages to the nozzle until the actuator is depressed. When the valves are opened, the first component flows from chamber 8, through openings 64 in the valve body and past valve portion 76, into passage 54. Simultaneously, the second component flows from chamber 7, through openings 81 in the valve stem and into passage 56.

Other embodiments are within the claims.

Figure 7:
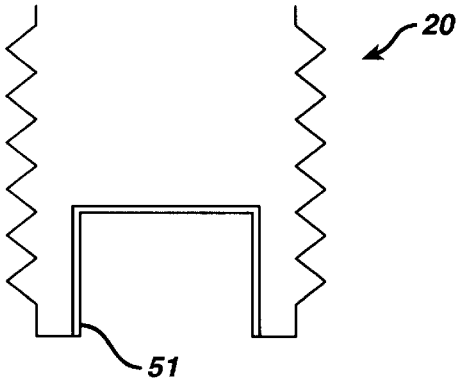
FIGS. 7 and 7A are partial sectional views of a portion of a receptacle for a dispenser according to an alternate embodiment of the invention, shown in a full and empty condition, respectively.
Figure 7A:
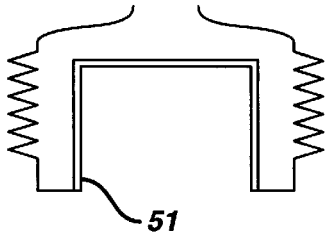

For example, as shown in FIGS. 7–7A, receptacle 20 may include a rigid, inwardly extending base portion 51 so that, when the receptacle is emptied, and thus completely compressed (FIG. 7A), there is less residual material left in the receptacle. (FIG. 7A shows the receptacle only, for clarity; the spring would be assembled onto the receptacle in a manner similar to that shown in FIGS. 8–8A.) The receptacle can be molded in the position shown in FIG. 7, or can be molded with the inwardly extending base portion 51 initially extending outwardly (FIG. 9) and the base portion pushed in prior to filling.

Figure 8:
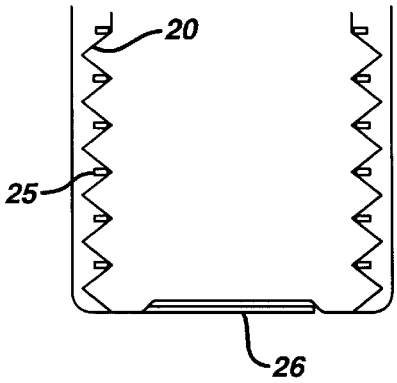
FIGS. 8 and 8A are partial sectional views of a portion of a receptacle for a dispenser according to another alternate embodiment of the invention, shown in a full and empty condition, respectively.
Figure 8A:
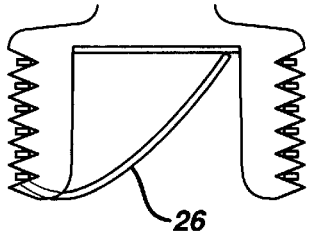
Figure 8B:
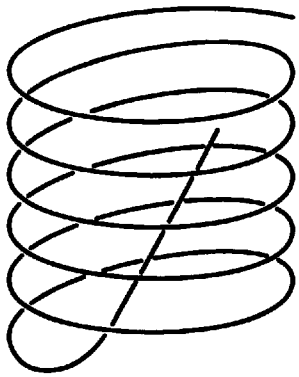
FIG. 8B is a side view of the spring used in the dispenser shown in FIGS. 8 and 8A.
Figure 9:
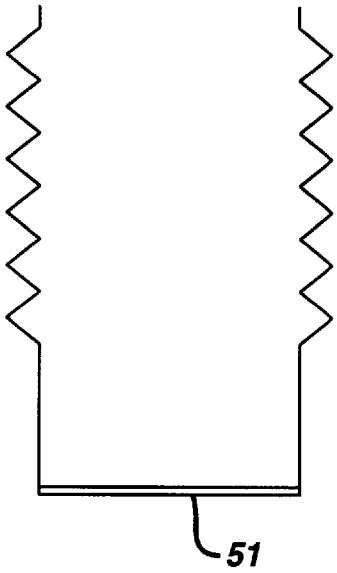
FIG. 9 is a partial sectional view of a preform for use in manufacturing the receptacle shown in FIGS. 7–7A.

An alternative way of achieving the same objective (i.e., emptying the receptacle as much as possible) is shown in FIGS. 8–8A. In this embodiment, spring 25 includes an upwardly extending tang 26, which is pressed flat when the receptacle is full, and subsequently springs up as the receptacle is emptied, to push out residual fluid after the receptacle is completely compressed. When the tang springs up, it pushes upward on the bottom portion of the receptacle which then rolls into itself, as shown in FIG. 8A.

What is claimed is:

1. A fluid dispenser comprising:

a flexible receptacle, having a closed end and an opposed open end, being movable from a collapsed condition to an elongate condition, and having an outer surface defining a helical thread; and a helical spring in threaded engagement with said helical thread to axially compress said receptacle;

wherein fluid introduced into said receptacle moves said receptacle from said collapsed condition to said elongate condition, producing tension in said spring, said tension being effective to move said receptacle from said elongate condition to said collapsed condition to force fluid from said receptacle.

2. The fluid dispenser of claim 1 further comprising a container having a closed end and an opposed open end, said open end of said receptacle being attached to said container adjacent the open end of said container and said receptacle being freely supported within said container.

3. The fluid dispenser of claim 1 further comprising a valve constructed to prevent fluid from being forced out of said receptacle until the dispenser is actuated by a user.

4. The fluid dispenser of claim 1 wherein said receptacle includes an outwardly projecting crest portion and an inwardly projecting root portion.

5. The fluid dispenser of claim 4 wherein said helical spring is disposed on said root portion.

6. The fluid dispenser of claim 4 wherein said helical spring is encased within said root portion.

7. The fluid dispenser of claim 1 wherein said receptacle is formed of a plastic material.

8. The fluid dispenser of claim 1 wherein said helical spring is formed of a metallic material.

9. A fluid dispenser comprising:

a first flexible receptacle having a closed end wall and an opposed open end, and an outer surface defining a helical thread that is movable from a collapsed condition to an elongate condition;

a second flexible receptacle, disposed within said first receptacle, having a closed end wall attached to said closed end wall of said first receptacle and an open end adjacent said open end of said first receptacle; and a helical spring threadedly received on said outer surface of said first receptacle;

whereby fluid material forced into said first receptacle is effective to move said first receptacle from a collapsed condition to an elongate condition producing tension in said spring, and said tension in said spring is effective to move said first receptacle from an elongate condition to a collapsed condition to force material from said first and second receptacles.

10. The fluid dispenser of claim 9 further comprising a valve constructed to prevent fluid from being forced out of said receptacle until the dispenser is actuated by a user.

11. The fluid dispenser of claim 9 wherein said helical thread includes an outwardly projecting crest portion and an inwardly projecting root portion.

12. The fluid dispenser of claim 11 wherein said helical spring is disposed on said root portion.

13. The fluid dispenser of claim 10 wherein said valve comprises a valve assembly constructed to translate between a closed position, in which said first and second receptacles are sealed, and an open position, in which first and second components flow simultaneously from said first and second receptacles to a dispensing head.

14. The fluid dispenser of claim 13 wherein said dispensing head defines a nozzle through which the product exits the dispensing head, a first passageway between said first receptacle and said nozzle, and a second passageway between said second receptacle and said nozzle.

15. The fluid dispenser of claim 11 wherein said valve assembly comprises first and second valve seats, and a valve stem including a first valve portion for sealing against said first valve seat to seal said first receptacle and a second valve portion for sealing against said second valve seat to seal said second receptacle.

16. The fluid dispenser of claim 15 wherein said valve assembly further comprises a spring that biases said first and second valve portions against the respective first and second valve seats.

17. The fluid dispenser of claim 16 wherein said valve assembly further comprises a valve body, and said spring, valve stem and valve seats are contained within said valve body as a modular unit.

* * * * *